US010738409B2

(12) United States Patent
Adkins

(10) Patent No.: US 10,738,409 B2
(45) Date of Patent: Aug. 11, 2020

(54) LAUNDRY TREATING APPLIANCE WITH A SENSOR

(71) Applicant: WHIRLPOOL CORPORATION, Benton Harbor, MI (US)

(72) Inventor: Andrew Adkins, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 162 days.

(21) Appl. No.: 15/798,759

(22) Filed: Oct. 31, 2017

(65) Prior Publication Data

US 2019/0127904 A1 May 2, 2019

(51) Int. Cl.

| | |
|---|---|
| ***D06F 58/04*** | (2006.01) |
| ***D06F 57/12*** | (2006.01) |
| ***D06F 58/30*** | (2020.01) |
| *D06F 58/38* | (2020.01) |
| *D06F 103/00* | (2020.01) |
| *D06F 103/02* | (2020.01) |
| *D06F 103/10* | (2020.01) |
| *D06F 103/38* | (2020.01) |
| *D06F 103/50* | (2020.01) |
| *D06F 105/26* | (2020.01) |

(52) U.S. Cl.

CPC ..... *D06F 58/04* (2013.01); *D06F 57/12* (2013.01); *D06F 58/30* (2020.02); *D06F 58/38* (2020.02); *D06F 2103/00* (2020.02); *D06F 2103/02* (2020.02); *D06F 2103/10* (2020.02); *D06F 2103/38* (2020.02); *D06F 2103/50* (2020.02); *D06F 2105/26* (2020.02)

(58) Field of Classification Search

CPC .. D06F 58/28; D06F 58/18; D06F 2058/2861; D06F 2058/2835; D06F 2058/2838; D06F 2058/2896; D06F 58/04; D06F 2058/2816

See application file for complete search history.

(56) References Cited

U.S. PATENT DOCUMENTS

| | | | | |
|---|---|---|---|---|
| 3,316,659 | A * | 5/1967 | Lauck | D06F 37/08 34/109 |
| 3,344,532 | A | 10/1967 | Bigler | |
| 5,519,949 | A | 5/1996 | Gibson, Jr. | |
| 5,806,204 | A * | 9/1998 | Hoffman | D06F 58/12 34/605 |
| 6,026,592 | A | 2/2000 | Herr | |
| 7,552,545 | B2 | 6/2009 | Crawford et al. | |
| 8,087,184 | B2 | 1/2012 | Banta et al. | |
| 8,528,228 | B2 * | 9/2013 | Ashrafzadeh | D06F 58/04 116/213 |
| 9,284,679 | B2 * | 3/2016 | Ashrafzadeh | D06F 58/04 |

(Continued)

FOREIGN PATENT DOCUMENTS

| | | |
|---|---|---|
| EP | 3124676 A1 | 2/2017 |
| KR | 100634804 B1 | 10/2006 |

*Primary Examiner* — Gregory A Wilson

(74) *Attorney, Agent, or Firm* — McGarry Bair PC

(57) ABSTRACT

An apparatus and method towards a laundry treating appliance for drying laundry comprising a rotatable drum at least partially defining a treating chamber and having a front and a rear where at least one conductivity sensor is located within the treating chamber, and a motor rotating the drum tumbles laundry within the treating chamber to enable contact of the laundry with the conductivity sensor.

29 Claims, 8 Drawing Sheets

(56) References Cited

U.S. PATENT DOCUMENTS

| | | | | |
|---|---|---|---|---|
| 10,260,194 | B2 * | 4/2019 | Green | D06F 25/00 |
| 2009/0100882 | A1 * | 4/2009 | Bae | D06F 39/008 68/5 C |
| 2012/0096738 | A1 * | 4/2012 | Bellinger | D06F 58/28 34/493 |
| 2015/0153104 | A1 | 6/2015 | Bae et al. | |
| 2015/0240407 | A1 | 8/2015 | Hendrickson et al. | |
| 2016/0160424 | A1 | 6/2016 | Kim et al. | |

* cited by examiner

LAUNDRY TREATING APPLIANCE WITH A SENSOR

BACKGROUND

Laundry treating appliances, in particular clothes dryers, can have a configuration based on a rotating drum that defines a treating chamber in which laundry items are placed for treating according to a cycle of operation. A controller can be operably connected with the dispensing system and can have various components of the laundry treating appliance to execute the cycle of operation. The cycle of operation can be selected manually by the user or automatically based on one or more conditions determined by the controller.

The effectiveness of the clothes dryer is based on how dry laundry is at the end of a cycle. Too dry of laundry, such as "bone dry" is harsh on the laundry and wastes energy as the laundry is over-dried, and not dry enough feels wet to the consumer, which can lead to an unnecessary service call. Typically, it is desired to stop the drying cycle when the laundry has a desired residual moisture content falling within a particular range (e.g., 2-4%). Sensors can be utilized to determine the moisture content in a load of laundry and communicate this information to the controller.

In some clothes dryers, a removable drying apparatus, such as a drying rack, container can be used for drying items separately from the standard tumbled load, i.e. delicates or shoes. Depending on the configuration, the removable drying apparatus can be used in place of or in combination with drying laundry in the treating chamber defined by the rotating drum.

SUMMARY

The present disclosure sets forth systems, components, and methodologies for a laundry treating appliance for drying laundry comprising a rotatable drum at least partially defining a treating chamber and having a front and a rear, a first sensor located at the front of the treating chamber and having a first sensing field and emitting a first data signal indicative of laundry within the sensing field, a removable basket removably mounted at the front of the treating chamber to form a space between a main portion of the treating chamber and the sensing field, and a controller receiving the first data signal and configured to execute a program to analyze the first data signal to determine the presence or absence of the removable basket.

Methods for operating a laundry treating appliance for drying laundry the method in accordance with the present disclosure comprising receiving at a controller a first data signal indicating a presence of laundry within a treating chamber, comparing the first data signal to a reference value, and determining a presence or absence of a removable basket within the treating chamber based on the comparison.

DESCRIPTION

Aspects of the disclosure relate to a laundry treating appliance that include a removable basket. The removable basket can be mounted or attached to a door providing access to a treating chamber of the laundry treating appliance. In one configuration, the laundry treating appliance is a dryer having sensors and a controller capable of receiving information collected by the sensors. In the event that the removable basket is attached to the door and therefore within the treating chamber during a drying cycle, the information received by the controller will be different than information collected when the removable basket is not in place. This difference enables a determination of the presence of the removable basket within the treating chamber.

In one aspect of the disclosure discussed herein the sensors are conductivity sensors located at a front and rear of the treating chamber. A first conductivity sensor located at the rear can be in contact with the tumbling load producing "hits" that are received at the controller. A "hit" occurs when wet laundry completes a circuit of the conductivity sensor. When in place, the removable basket can separate a second conductivity sensor located at the front of the treating chamber from a tumbling load of laundry within the treating chamber during operation. This can prevent contact between the tumbling load and the second conductivity sensor. The "hits" received at the controller by the second conductivity sensor would be less than "hits" received at the controller by the first conductivity sensor when the removable basket is in place. Upon receiving information indicating that the "hits" at the second conductivity sensor are less than "hits" at the first conductivity sensor, it is determined that the removable basket is present within the laundry treating chamber. Upon determining the presence of a removable laundry treating appliance, a predetermined time is added onto the dry cycle to ensure all laundry within the laundry treating chamber are dry upon completion of the cycle.

It is further contemplated that the sensors within the chamber that are part of determining the presence of the removable basket are thermistors. It is also further contemplated that thermistors within the laundry treating appliance provide back up, or secondary information to the controller to determine the presence of a removable basket within the laundry treating chamber.

Figure 1:
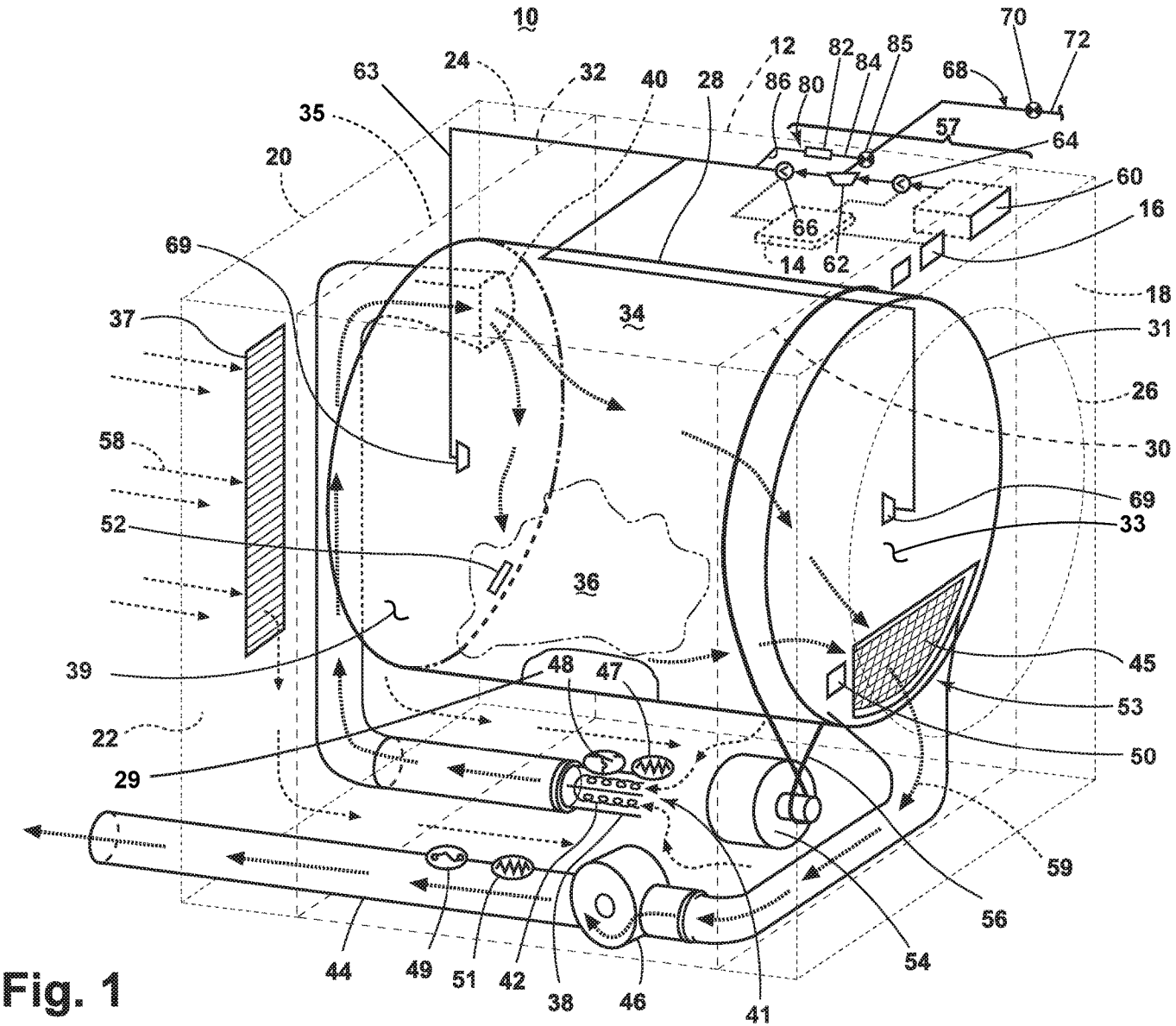
FIG. 1 is a schematic view of a laundry treating appliance in the form of a clothes dryer including sensors.

By way of overview, FIG. 1 is illustrative of an example of a laundry treating appliance in the form of a clothes dryer 10 that can be controlled according to aspects of the disclosure described herein. While aspects of the disclosure described herein are in the context of a clothes dryer 10, the disclosure is not so limited and can be used with any type of laundry treating appliance, non-limiting examples of which include a washing machine, a combination washing machine and dryer and a refreshing/revitalizing machine.

As illustrated in FIG. 1, the clothes dryer 10 can include a cabinet 12 in which is provided a controller 14 that can receive input from a user through a user interface 16 for selecting a cycle of operation and controlling the operation of the clothes dryer 10 to implement the selected cycle of operation.

The cabinet 12 can be defined by a front wall 18, a rear wall 20, and a pair of side walls 22 supporting a top wall 24. A chassis can be provided with the walls being panels mounted to the chassis. A door 26 can be hingedly mounted to the front wall 18 and can be selectively movable between opened and closed positions to close an opening in the front wall 18, which provides access to the interior of the cabinet 12.

A rotatable drum 28 can be disposed within the interior of the cabinet between opposing stationary front and rear ends comprising bulkheads 30, 32 wherein the front bulkhead 30 defines a front wall 31 of the drum 28 and rotationally supports an open front 33 and the rear bulkhead 32 defines a rear wall 35 of the drum 28 closing an open rear 39 of the drum 28. The rear wall 35 of the drum 28 along with the door 26 and the rotatable drum 28 collectively define a treating chamber 34. As illustrated, the treating chamber 34 is not fluidly coupled to a drain, though other implementations may include drain lines. Thus, in this implementation, liquid introduced into the treating chamber 34 will not be removed merely by draining. The rotatable drum is for tumble drying a main clothes load 36 within the treating chamber 34.

Non-limiting examples of laundry that can be treated according to a cycle of operation include, a hat, a scarf, a glove, a sweater, a blouse, a shirt, a pair of shorts, a dress, a sock, a pair of pants, a shoe, an undergarment, and a jacket. Furthermore, textile fabrics in other products, such as draperies, sheets, towels, pillows, and stuffed fabric articles (e.g., toys), can be treated in the clothes dryer 10.

The drum 28 can include at least one lifter 29. In most dryers, there can be multiple lifters. The lifters can be located along an inner surface of the drum 28 defining an interior circumference of the drum 28. The lifters can facilitate movement of the main clothes load 36 within the drum 28 as the drum 28 rotates.

The drum 28 can be operably coupled with a motor 54 to selectively rotate the drum 28 during a cycle of operation. The coupling of the motor 54 to the drum 28 can be direct or indirect. As illustrated, an indirect coupling can include a belt 56 coupling an output shaft of the motor 54 to a wheel/pulley on the drum 28. A direct coupling can include the output shaft of the motor 54 coupled to a hub of the drum 28.

An air system can be provided to the clothes dryer 10. The air system supplies air to the treating chamber 34 and exhausts air from the treating chamber 34. The supplied air can be heated or not. The air system can have an air supply portion that can form, in part, a supply conduit 38 with an air inlet 41 open to ambient air via a rear vent 37 and another end fluidly coupled to an inlet grill 40, which can be in fluid communication with the treating chamber 34. A heating element 42 can lie within the supply conduit 38 and can be operably coupled to and controlled by the controller 14. If the heating element 42 is turned on, the supplied air will be heated prior to entering the drum 28.

The air system can further include an air exhaust portion that can be formed in part by an exhaust conduit 44. A lint trap 45 can be provided as the inlet from the treating chamber 34 to the exhaust conduit 44. A blower 46 can be fluidly coupled to the exhaust conduit 44. The blower 46 can be operably coupled to and controlled by the controller 14. Operation of the blower 46 draws air into the treating chamber 34 as well as exhausts air from the treating chamber 34 through the exhaust conduit 44. The exhaust conduit 44 can be fluidly coupled with a household exhaust duct (not shown) for exhausting the air from the treating chamber 34 to the outside of the clothes dryer 10.

The air system can further include various sensors and other components, such as at least one thermistor, or an inlet thermistor 47 and a thermostat 48, which can be coupled to the supply conduit 38 in which the heating element 42 can be positioned. The inlet thermistor 47 and the thermostat 48 can be operably coupled to each other. Alternatively, the inlet thermistor 47 can be coupled to the supply conduit 38 at or near to the inlet grill 40. Regardless of its location, the inlet thermistor 47 can be used to aid in determining an inlet temperature (IT) of air entering the treating chamber 34. Another thermistor, or outlet thermistor 51 and a thermal fuse 49 can be coupled to the exhaust conduit 44 proximate an air outlet 53 of the treating chamber 34, with the outlet thermistor 51 being used to determine an outlet temperature (OT) of air exiting the treating chamber. Alternatively, the outlet thermistor 47 can be coupled to the exhaust conduit 44 at or near to the lint trap 45.

A first conductivity sensor 50 can be positioned in the interior of the treating chamber 34 to monitor the amount of moisture of the laundry in the treating chamber 34. The first conductivity sensor 50 can be located at the front of the treating chamber 34 at a bottom portion of the front wall 31 of the drum 28. It is also contemplated that the first conductivity sensor 50 can be integrated with the lint trap 45 or at any location in the interior of the dispensing dryer 10 such that the first conductivity 50 can accurately sense the moisture content of the laundry. A second conductivity sensor 52 can be mounted at the rear of the treating chamber 34, for example, on the real wall 35 of the drum 28 as illustrated. The conductivity sensors 50, 52 can be operably coupled to the controller 14 such that the controller 14 receives output from the conductivity sensors 50, 52. While two conductivity sensors 50, 52 are illustrated, this is not meant to be limiting and other configurations can be contemplated.

Each conductivity sensor 50, 52 is normally two, spaced strips of metal forming part of an electrical circuit such that when a laundry item touches both strips it closes the circuit, which lets an electrical signal pass through, which is registered as a "hit". The circuit is coupled to the controller 14, which can monitor/analyze the frequency and duration of the hits over time to assess the dryness of the load. As the load dries, the frequency and duration will lessen as dry laundry is not as conductive as wet laundry.

The determination of a "dry" load can be based on the moisture content of the laundry, which may be set by the user based on the selected cycle, an option to the selected cycle, or a user-defined preference. The moisture content can be determined using a single moisture sensor, such as a conductivity sensor, located at the front of the treating chamber. The conductivity sensor can be used to calculate a projected drying time. In exemplary implementations, the conductivity sensors are not used for an absolute determination of dryness because they may not be accurate below approximately 10% moisture content and a load (at least in certain exemplary implementations) is typically not considered dry unless it has less than 5% moisture content or, more typically, 2-4%. Thus, the output of the conductivity sensor is used to calculate a drying time that is expected to have less than 5% moisture content.

Together the inlet and outlet thermistors 47, 51 can provide a thermal signal for an end of cycle estimation when either a signal from the conductivity sensors is no longer being produced because all of the laundry is wet, or an error has occurred. Additionally, when the dryness level drops below 10% a thermal signal from the inlet and outlet thermistors 47, 51 can be utilized to determine an end of cycle estimation time.

Together the inlet and outlet thermistors 47, 51 along with the first and second conductivity sensors 50, 52 can provide information as a single model to the controller 14. The single model can use information from the inlet and outlet thermistors 47, 51 to determine the temperature differential between incoming and outgoing air. This information can be in addition to or compared with the moisture content of the laundry sensed by the first and second conductivity sensors. These four pieces of input can together form the single model necessary for determining an end of cycle for the clothes dryer 10.

A dispensing system 57 can be provided for the clothes dryer 10 to dispense one or more treating chemistries to the treating chamber 34 according to a cycle of operation. As illustrated, the dispensing system 57 can be located in the interior of the cabinet 12 although other locations are also possible. The dispensing system 57 can be fluidly coupled to a water supply 68. The dispensing system 57 can be further coupled to the treating chamber 34 through one or more nozzles 69. As illustrated, nozzles 69 are provided to the front and rear of the treating chamber 34 to provide the treating chemistry or liquid to the interior of the treating chamber 34, although other configurations are also possible.

As illustrated, the dispensing system 57 can include a reservoir 60, which can be a cartridge, for a treating chemistry that is releasably coupled to the dispensing system 57, which dispenses the treating chemistry from the reservoir 60 to the treating chamber 34. The reservoir 60 can include one or more cartridges configured to store one or more treating chemistries in the interior of cartridges. A suitable cartridge system can be found in U.S. Pub. No. 20150240407 to Hendrickson et al., filed Apr. 28, 2015, entitled "Method for Converting a Household Cleaning Appliance with a Non-Bulk Dispensing System to a Household Cleaning Appliance with a Bulk Dispensing System," which is herein incorporated by reference in its entirety.

A mixing chamber 62 can be provided to couple the reservoir 60 to the treating chamber 34 through a supply conduit 63. Pumps such as a metering pump 64 and a delivery pump 66 can be provided to the dispensing system 57 to selectively supply a treating chemistry and/or liquid to the treating chamber 34 according to a cycle of operation. The water supply 68 can be fluidly coupled to the mixing chamber 62 to provide water from the water source to the mixing chamber 62. The water supply 68 can include an inlet valve 70 and a water supply conduit 72. It is noted that, instead of water, a different treating chemistry can be provided from the exterior of the clothes dryer 10 to the mixing chamber 62.

The treating chemistry can be any type of aid for treating laundry, non-limiting examples of which include, but are not limited to, water, fabric softeners, sanitizing agents, de-wrinkling or anti-wrinkling agents, and chemicals for imparting desired properties to the laundry, including stain resistance, fragrance (e.g., perfumes), insect repellency, and UV protection.

The dryer 10 can also be provided with a steam generating system 80 which can be separate from the dispensing system 57 or integrated with portions of the dispensing system 57 for dispensing steam and/or liquid to the treating chamber 34 according to a cycle of operation. The steam generating system 80 can include a steam generator 82 fluidly coupled with the water supply 68 through a steam inlet conduit 84. A fluid control valve 85 can be used to control the flow of water from the water supply conduit 72 between the steam generating system 80 and the dispensing system 57. The steam generator 82 can further be fluidly coupled with the one or more supply conduits 63 through a steam supply conduit 86 to deliver steam to the treating chamber 34 through the nozzles 69. Alternatively, the steam generator 82 can be coupled with the treating chamber 34 through one or more conduits and nozzles independently of the dispensing system 57.

The steam generator 82 can be any type of device that converts the supplied liquid to steam. For example, the steam generator 82 can be a tank-type steam generator that stores a volume of liquid and heats the volume of liquid to convert the liquid to steam. Alternatively, the steam generator 82 can be an in-line steam generator that converts the liquid to steam as the liquid flows through the steam generator 82.

It will be understood that any suitable dispensing system and/or steam generating system can be used with the dryer 10. It is also within the scope of the invention for the dryer 10 to not include a dispensing system or a steam generating system.

Figure 2:
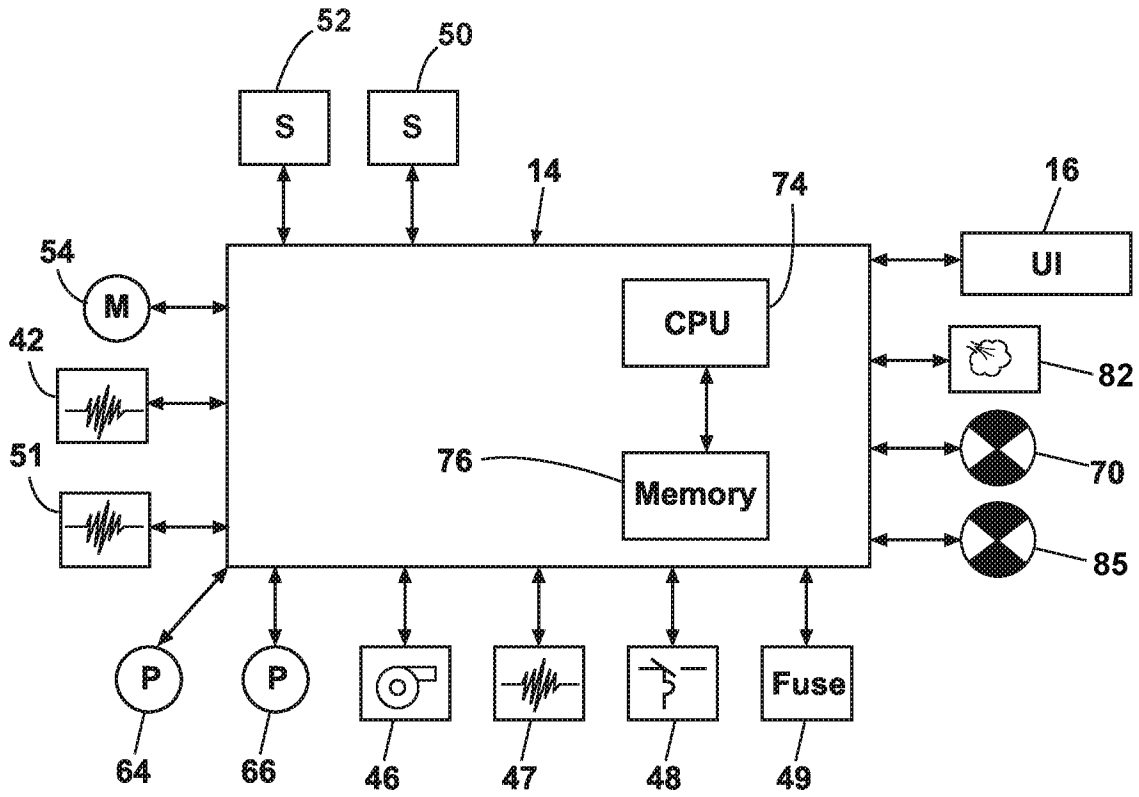
FIG. 2 is a schematic view of a controller for the clothes dryer in FIG. 1.

FIG. 2 is a schematic view of the controller 14 coupled to the various components of the dryer 10. The controller 14 can be communicably coupled to components of the clothes dryer 10 such as the heating element 42, blower 46, inlet thermistor 47, thermostat 48, thermal fuse 49, outlet thermistor 51, first and second conductivity sensor 50, 52, motor 54, inlet valve 70, pumps 64, 66, steam generator 82 and fluid control valve 85 to either control these components and/or receive their input for use in controlling the components. The controller 14 is also operably coupled to the user interface 16 to receive input from the user through the user interface 16 for the implementation of the drying cycle and provide the user with information regarding the drying cycle.

The user interface 16 can be provided with operational controls such as dials, lights, knobs, levers, buttons, switches, and displays enabling the user to input commands to a controller 14 and receive information about a treatment cycle from components in the clothes dryer 10 or via input by the user through the user interface 16. The user can enter many different types of information, including, without limitation, cycle selection and cycle parameters, such as cycle options. Any suitable cycle can be used. Non-limiting examples include, Casual, Delicate, Super Delicate, Heavy Duty, Normal Dry, Damp Dry, Sanitize, Quick Dry, Timed Dry, and Jeans.

The controller 14 can implement a treatment cycle selected by the user according to any options selected by the user and provide related information to the user. The controller 14 can also comprise a central processing unit (CPU) 74 and an associated memory 76 where various treatment cycles and associated data, such as look-up tables, can be stored. One or more software applications, such as an arrangement of executable commands/instructions can be stored in the memory and executed by the CPU 74 to implement the one or more treatment cycles.

In general, the controller 14 will effect a cycle of operation to effect a treating of the laundry in the treating chamber 34, which can or cannot include drying. The controller 14 can actuate the blower 46 to draw an inlet air flow 58 into the supply conduit 38 through the rear vent 37 when air flow is needed for a selected treating cycle. The controller 14 can activate the heating element 42 to heat the inlet air flow 58 as it passes over the heating element 42, with the heated air 59 being supplied to the treating chamber 34. The heated air 59 can be in contact with the main clothes load 36 as it passes through the treating chamber 34 on its way to the exhaust conduit 44 to effect a moisture removal of the laundry. The heated air 59 can exit the treating chamber 34, and flow through the blower 46 and the exhaust conduit 44 to the outside of the clothes dryer 10. The controller 14 continues the cycle of operation until completed. If the cycle of operation includes drying, the controller 14 determines when the laundry is dry. The determination of a "dry" load can be made in different ways, but is often based on the moisture content of the laundry, which is typically set by the user based on the selected cycle, an option to the selected cycle, or a user-defined preference.

During a cycle of operation, one or more treating chemistries can be provided to the treating chamber 34 by the dispensing system 57 as actuated by the controller 14. To dispense the treating chemistry, the metering pump 64 is actuated by the controller 14 to pump a predetermined quantity of the treating chemistry stored in the reservoir 60 to the mixing chamber 62, which can be provided as a single charge, multiple charges, or at a predetermined rate, for example. The treating chemistry can be in the form of a gas, liquid, solid, gel or any combination thereof, and can have any chemical composition enabling refreshment, disinfection, whitening, brightening, increased softness, reduced odor, reduced wrinkling, stain repellency or any other desired treatment of the laundry. The treating chemistry can be composed of a single chemical, a mixture of chemicals, or a solution of a solvent, such as water, and one or more chemicals.

Figure 3A:
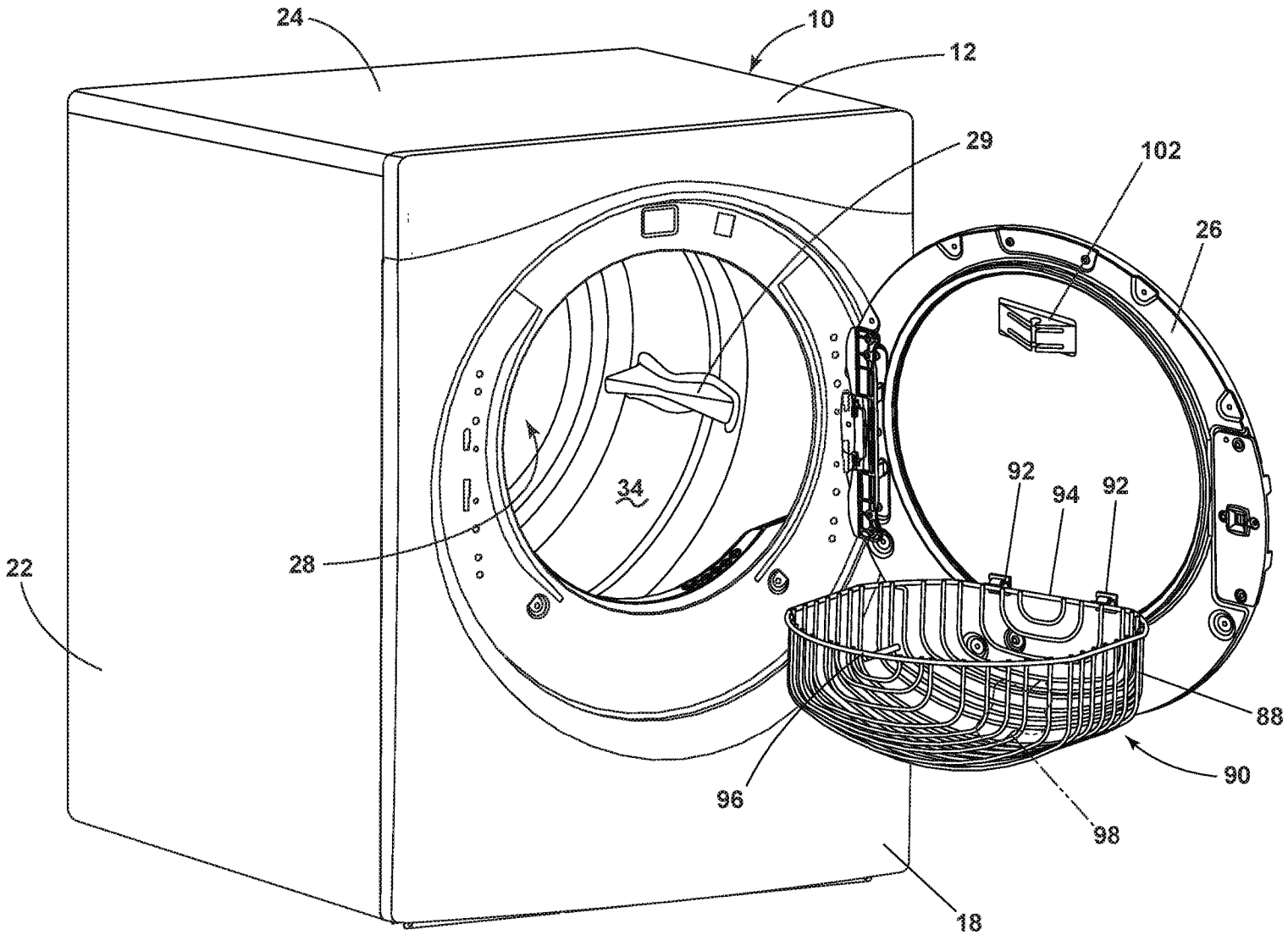
FIG. 3A is a perspective view of the clothes dryer in FIG. 1 with a removable basket in a first position.

Turning to FIG. 3A, a perspective view of the clothes dryer 10 illustrates a removable basket 88 removably mounted to the door 26 in a first position 90. The door 26 for the clothes dryer 10 can include at least one hinge component 92, illustrated as two hinge components, to which the basket 88 is mounted. The removable basket 88 can be, by way of non-limiting example, snapped into place at a first fixed end 94 such that a free end 96 can be rotatably moveable about the at least one hinge component 92 in an up and down direction. The removable basket 88 remains in the first position 90 in order to accommodate one or more stationary laundry items 98 not suitable for tumble drying within the treating chamber 34. By way of non-limiting example laundry items for the removable basket 88 can include but are not limited to delicates, undergarments, and shoes.

Figure 3B:
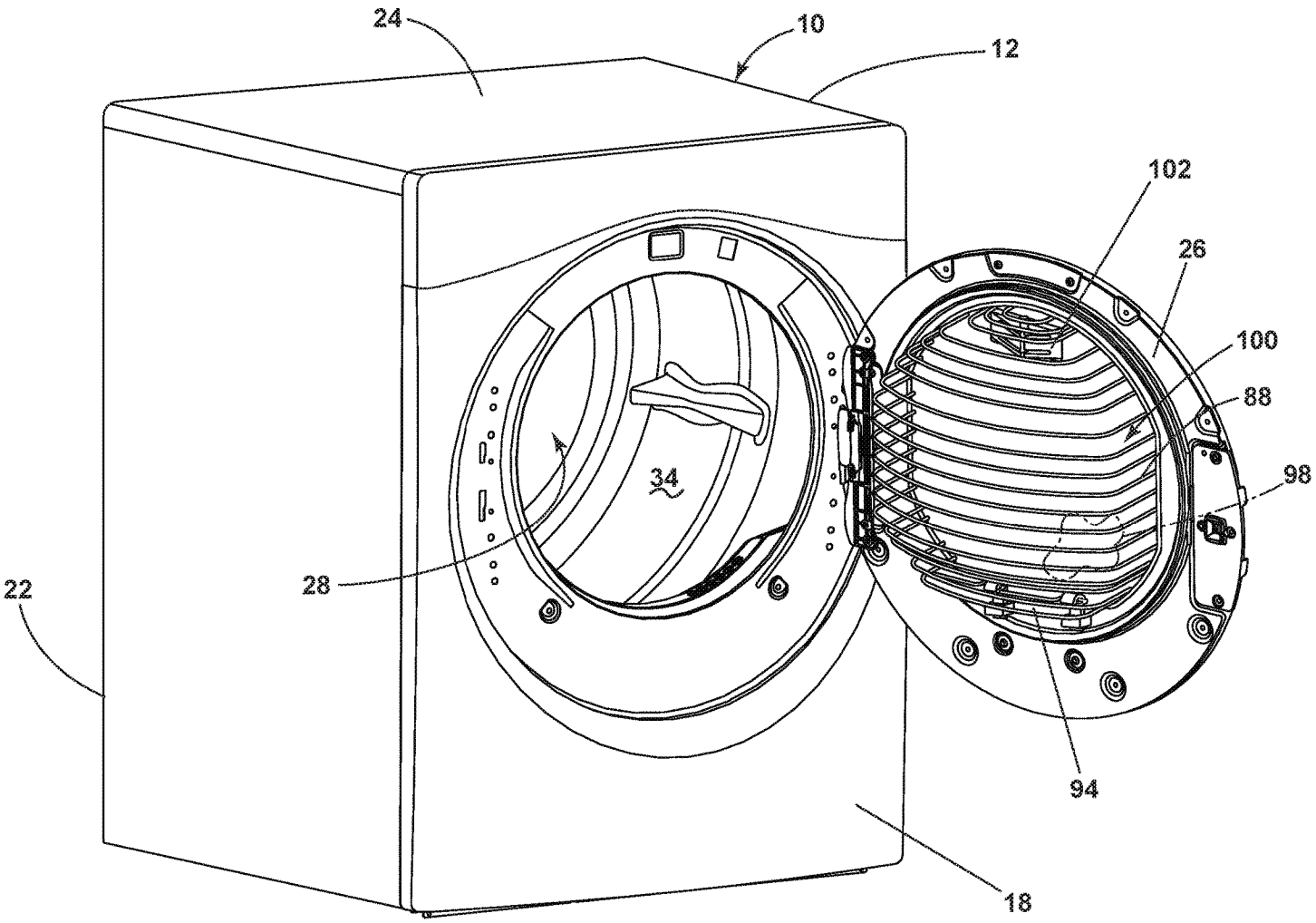
FIG. 3B is a perspective view of the clothes dryer in FIG. 1 with a removable basket in a second position.

FIG. 3B is similar to FIG. 3A, only the removable basket 88 is in a second position 100. A mounting component, by way of non-limiting example a clasp 102 is located on the door 26 to receive the free end 96. The free end 96 can be, by way of non-limiting example, snap fit to the clasp 102 when in the second position 100. When the removable basket 88 is in the second position 100, the door 26 can be closed and the clothes dryer 10 can commence in a drying cycle.

Figure 4:
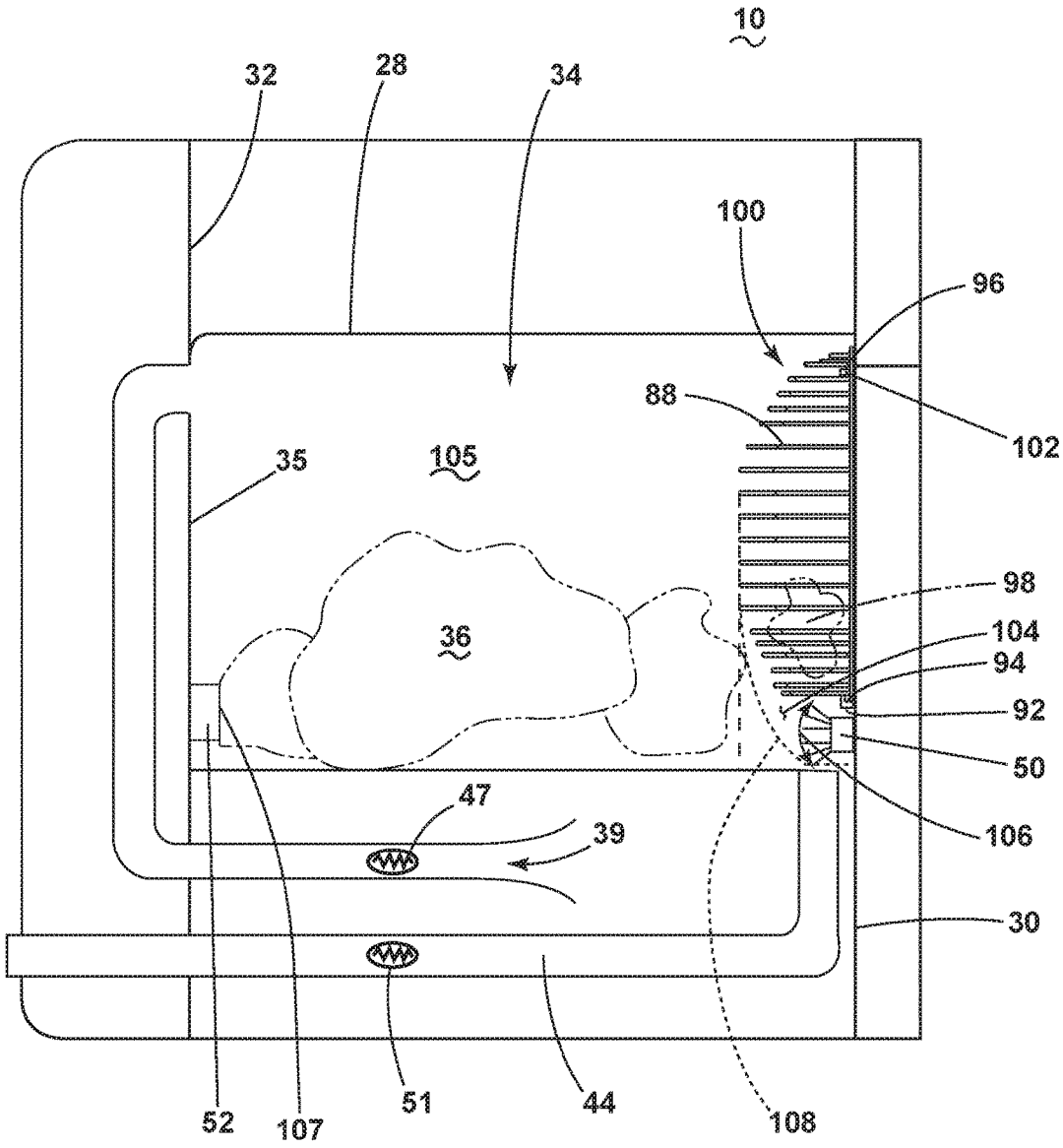
FIG. 4 is a schematic side view of the clothes dryer in FIG. 1 with the removable basket in the second position.

FIG. 4 is a schematic side view illustration of the clothes dryer 10 with the removable basket 88 in the second position 100. The removable basket 88 extends into the treating chamber 34 to define a space 104 disposed beneath the removable basket 88 and defined by the removable basket 88 and the drum 28. The space 104 overlaps with a first sensing field 106 of the first conductivity sensor 50 that is defined as a small area directly in front of the conductivity sensor 50. The space 104 is between a main portion 105 of the treating chamber 34 and the first sensing field 106. The second conductivity sensor 52 includes a second sensing field 107. When main clothes load 36 comes into the first or second sensing fields 106, 107, hits can be generated. During operation, main clothes load 36 within the treating chamber 34 can come into the first sensing field 106 of the first conductivity sensor 50 along the front wall 31 of the drum 28. However, due to the space 104 formed, the main clothes load 36 is retarded from contacting, or has little contact with, the first conductivity sensor 50 located at the front, or proximate the bulkhead 30, of the clothes dryer 10, especially as compared to when the removable basket 88 is not in place.

Figure 5:
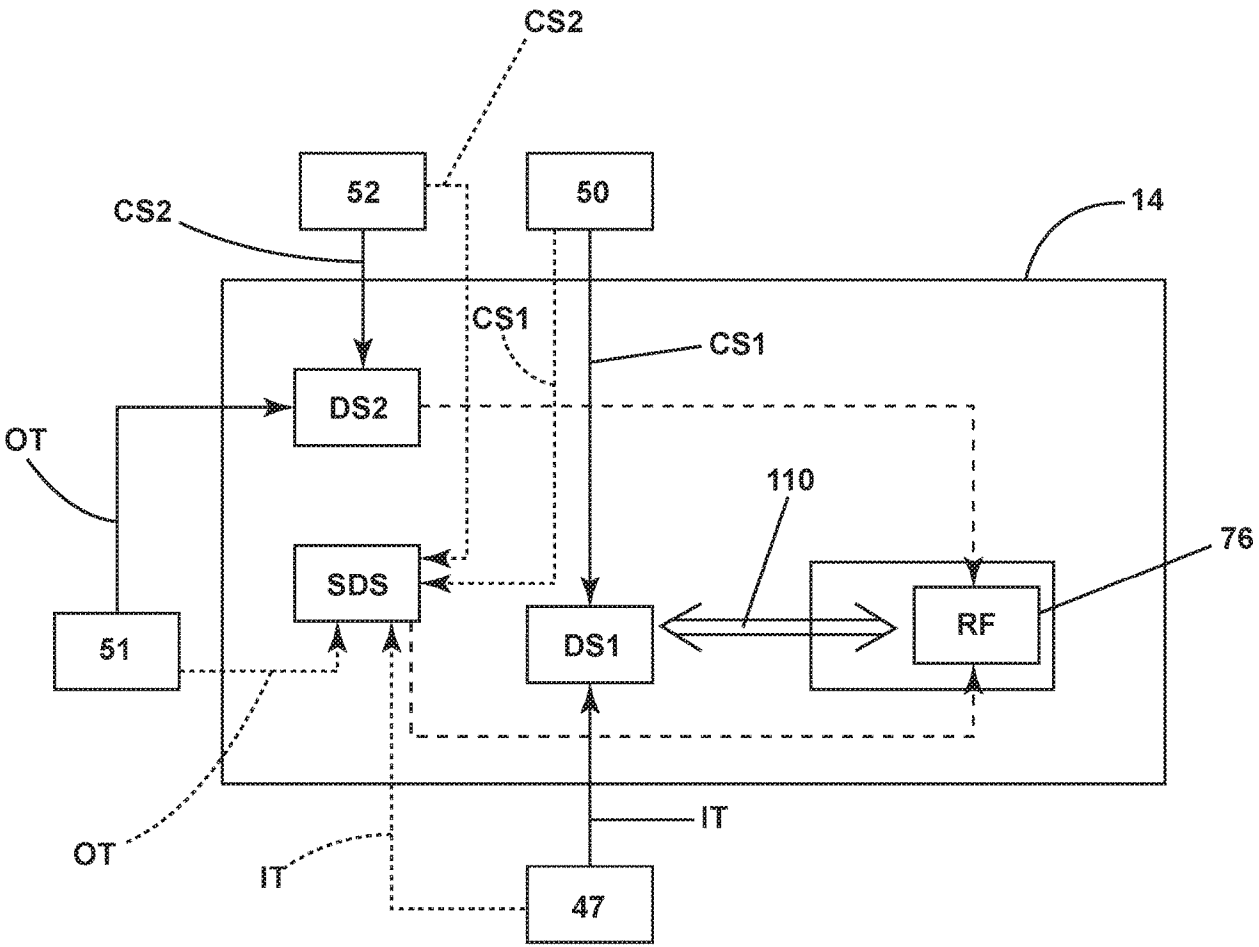
FIG. 5 is a schematic view of the controller of FIG. 2 illustrating data inputs from the sensors of the laundry treating appliance.

FIG. 5 is another schematic of the controller 14 in which input received at the controller 14 by the sensors as described herein is illustrated. The first conductivity sensor 50 can emit a first conductivity signal (CS1), specifically the number of hits received by the first conductivity sensor 50. The inlet thermistor 47 can emit the inlet temperature (IT) as described herein. Either the first conductivity signal (CS1) or the inlet temperature (IT) can be received at the controller as a first data signal (DS1). The second conductivity sensor 52 can output a second conductivity signal (CS2) and the outlet thermistor 51 can output the outlet temperature (OT). Both the second conductivity signal (CS2) and the outlet temperature (OT) can be received at the controller as a second data signal (DS2).

A starting data signal (SDS) can be received at the controller 14 at the beginning of a cycle as a baseline for the particular main clothes load 36 within the treating chamber 34. The starting data signal (SDS) can be a sensed moisture content within the dryer determined by utilizing any one of the first conductivity signal (CS1), second conductivity sensor (CS2), inlet temperature (IT), or outlet temperature (OT) from the first or second conductivity sensors 50, 52 or from the inlet or outlet thermistors 47, 51. It is also contemplated that all four signals can be used to develop the baseline for the laundry load currently within the dryer.

Furthermore, a reference value (RV) can be data collected and stored in the memory 76 of the controller 14 during manufacture based, by way of non-limiting example, on a normal drying cycle with no removable basket 88 present. It is also contemplated that the reference signal (RV) is the second data signal (DS2). It is further contemplated that the starting data signal (SDS) can be used to determine the reference value (RV) as well. The controller 14 can compare 110 the data received as the reference signal (RV) with data received as the first data signal (DS1). The data received at the controller can be analyzed and compared using an algorithm, by way of non-limiting example model based sensing. In one implementation of the disclosure as described herein, the controller 14 is configured to execute a program to analyze the first data signal (DS1), to determine the presence or absence of the removable basket 88. The program can also analyze both the first data signal (DS1) and the second data signal (DS2), in one non-limiting example by comparing the first data signal (DS1) to the second data signal (DS2) as part of the analysis.

The controller 14 can have a database or datatable containing test data of hit and/or duration values that are indicative of typical loads. Thus, when the registered hit/duration values do not match the signals received, the controller 14 can use it to determine that the removable basket 88 is retarding access to the first conductivity sensor 50, especially if the second conductivity sensor 52 is sending out "standard" or expected values.

Figure 6:
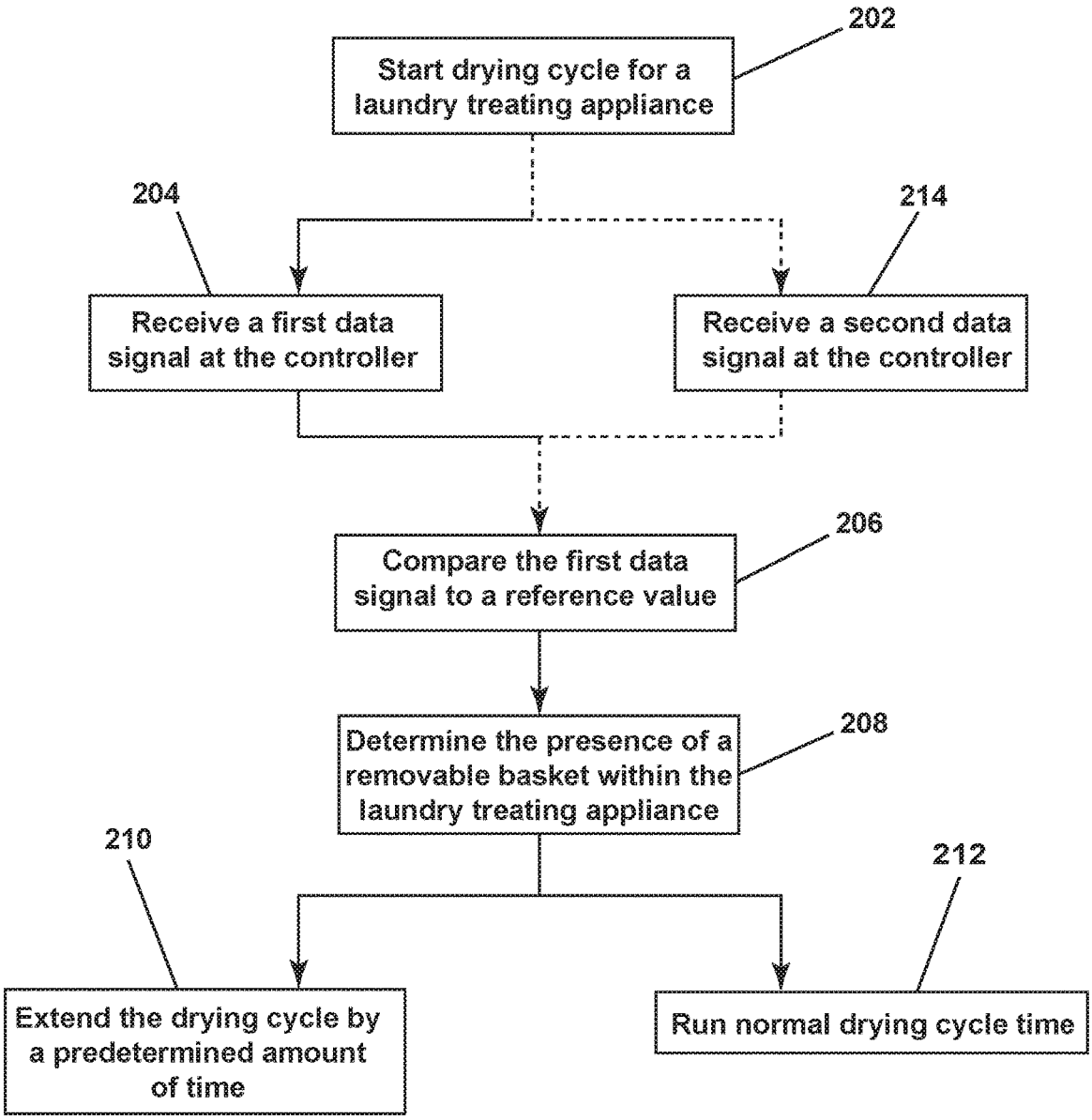
FIG. 6 is a flow chart of a method for operating the clothes dryer of FIG. 1.

A method 200 for operating the clothes dryer 10 with the removable basket 88 is outlined in a flow chart illustrated in FIG. 6. Upon commencing a drying cycle at 202, main clothes load 36 tumbles within the clothes dryer 10. The controller 14 then receives the first data signal (DS1) at 204. The first data signal (DS1) is emitted from a first sensor, by way of non-limiting example the first conductivity signal (CS1) is emitted from the first conductivity sensor 50. The first data signal (DS1) is then compared to the reference value (RV) at 206. The comparison enables a determination at 208 of the presence or absence of the removable basket 88 within the treating chamber 34.

Upon determining the presence of the removable basket 88, the controller 14 takes an action. By way of non-limiting example the action can be modifying a cycle selected for the main clothes load 36 by extending at 210 the drying time for the main clothes load 36 for a predetermined amount of time. The predetermined amount of time can be based on a percentage of a cycle time already performed, or can simply be a given time based on the starting data signal (SDS). By way of non-limiting example, the predetermined time can be any time between 10 and 20 minutes. The action can also include indicating to the user, via the user interface 16, that the presence of the removable basket 88 has been detected. It should be understood that if the removable basket 88 is determined not to be present, at 212 a normal drying cycle will run through a set amount of time.

It is further contemplated that the second data signal (DS2) can also be received at the controller 14 at 214. The second data signal (DS2) can be similarly based on data collected from a second sensor, by way of non-limiting example the second conductivity signal (CS2) from the second conductivity sensor 52. Throughout the duration of the clothes cycle, main clothes load 36 can come in contact with the first and second conductivity sensors 50, 52. When the removable basket 88 is in place and the space 104 is created, the first data signal (DS1) will be significantly different than the second data signal (DS2). More specifically the first conductivity signal (CS1) will be less than the second conductivity signal (CS2) because the first conductivity sensor 50 is receiving less hits due to the space 104 created by the removable basket 88 which prevents main clothes load 36 from contacting the second conductivity sensor 52 with as much frequency as the first conductivity sensor 50.

Figure 7:
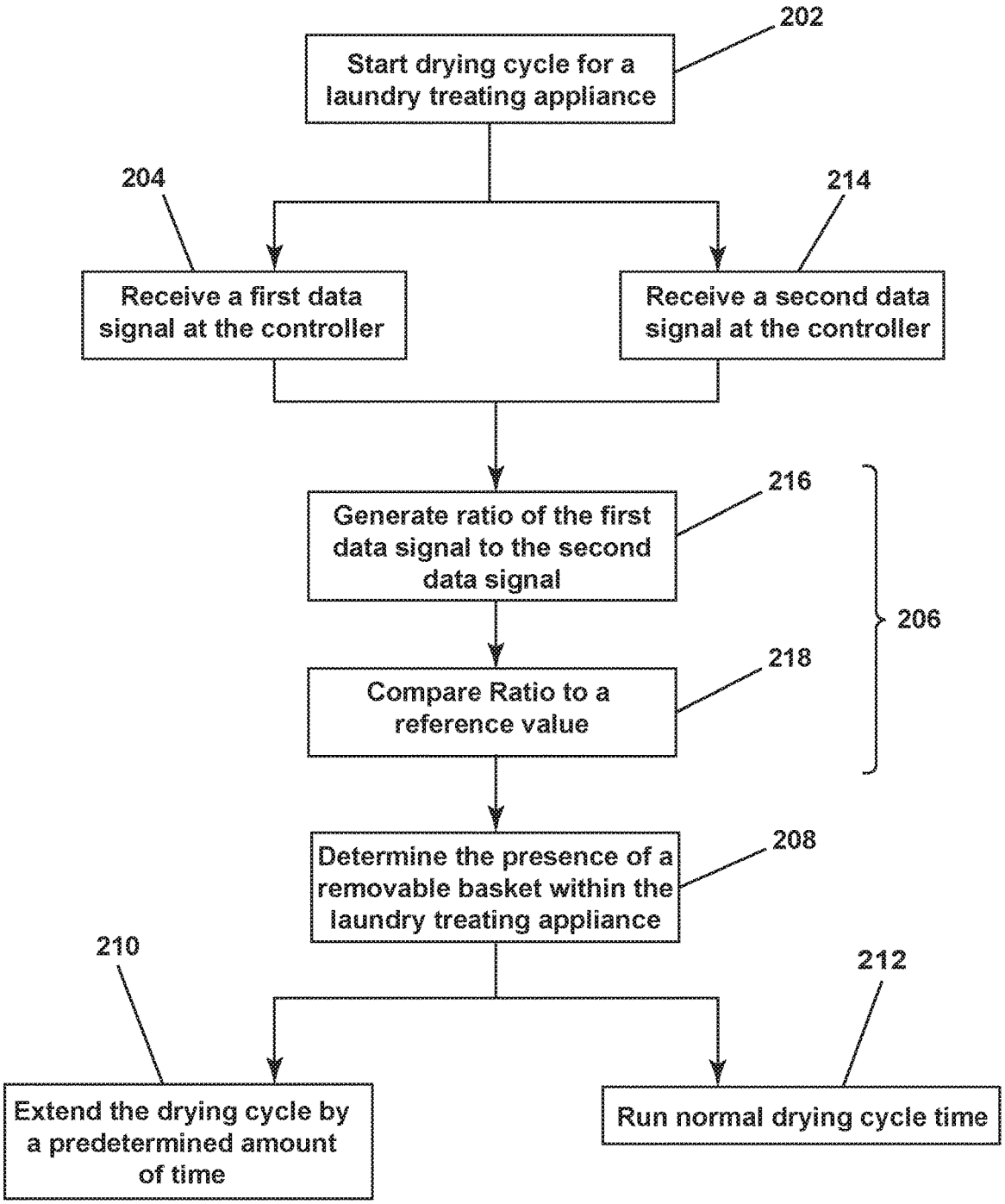
FIG. 7 is a flow chart of the method of FIG. 6 according to an aspect of the disclosure described herein.

As is illustrated in FIG. 7, the method 200 as described herein can have step 206 more specifically include at 216 generating a ratio between the second conductivity signal (CS2) and the first conductivity signal (CS1) and at 218 comparing that ratio to the reference value (RV). When the removable basket 88 is in place, CS2 is greater than CS1 creating a ratio well above a value of 1.0.

In another implementation of the method, the controller receives the first data signal (DS1) as the inlet temperature (IT) from a first sensor that is the inlet thermistor 47. Similarly the second data signal (DS2) can be the outlet temperature (OT). Temperature ranges recorded between the inlet thermistor 47 and the outlet thermistor 51 under operating conditions without the removable basket 88 can be stored as the reference value (RV) in the memory 76 of the controller 14. During a drying cycle, a range of temperatures between the inlet temperature (IT) and the outlet temperature (OT) received at the controller can be compared to the reference value (RV). If the range of temperatures recorded is significantly different than the stored reference value (RV), it is determined that the removable basket 88 is in the treating chamber 34. Air traveling around items in the removable basket 88 will pick up the thermal properties unique to a drying cycle with the removable basket 88 in place enabling an update of drying cycle algorithms to properly and more accurately depict when the drying cycle should terminate.

Finally it is further contemplated that the method as described herein can utilize both sets of sensors described herein. By way of non-limiting example, the first and second conductivity sensors 50, 52 can be the primary sensors for determining the first data signal (DS1) and the second signal (DS2) and the inlet and outlet thermistors 47, 51 can be used to confirm the readings by the first and second conductivity sensors 50, 52, or be used as a back-up in the event the first and/or second conductivity sensor 50, 52 fails. It should be understood that any combination of sensors is contemplated and that the first and second sensors are described in terms of conductivity sensors and thermistors for illustrative purposes and the method as described is not limited to utilizing conductivity sensors and thermistors.

It should be understood that the first data signal (DS1) will be near or approximate to a "normal" value, while the second data signal (DS2) will be less than a normal value or different than the "normal value". In the specific case of the second data signal (DS2) being the second conductivity signal (CS2), it will be much less than the first conductivity signal (CS1).

It should be further understood, that when the removable basket 88 is removed, the first data signal (DS1) is not necessarily equal to the second data signal (DS2). The actual number of hits received at the first or second conductivity sensors 50, 52 depend on the dryer configuration. Some dryers are configured such that one of the sensors will naturally receive more hits than another. By way of non-limiting example, some dryer drums rotate about a slightly inclined horizontal axis, which results in the laundry building up along the rear of the drum, which means the first conductivity sensor 50 would receive more hits. Any comparisons described herein, therefore, can adjust for a magnitude of difference between the first data signal (DS1) and the second data signals (DS2) and not simply the presence of a difference.

While illustrated as being outside the removable basket 88, it is also contemplated that the second conductivity sensor 52 is within the removable basket 88 when the removable basket 88 is in the second position 100. It is further contemplated, therefore that the space 104 formed would be determined by a portion 108 of the removable basket 88 that overlies the conductivity sensor 52.

Benefits associated with the embodiments described herein include increasing efficiency and effectiveness of a dryer with an optional removable basket by providing multiple inputs of information to the controller regarding the moisture content of the treating chamber 34 for the clothes dryer. The algorithm, as described herein, by detecting the removable basket in place, will allow for easier detection of load size and load type by having distinguishable drying profiles set up for many common consumer loads. Additionally when detection of the removable basket has been found, other algorithms can be bypassed that need not run if the removable basket is in place.

While the invention has been specifically described in connection with certain specific embodiments thereof, it is to be understood that this is by way of illustration and not of limitation, and the scope of the appended claims should be construed as broadly as the prior art will permit. It should also be noted that all elements of all of the claims can be combined with each other in any possible combination, even if the combinations have not been expressly claimed.

What is claimed is:

1. A laundry treating appliance for drying laundry comprising:

a rotatable drum having a front and a rear for tumble drying a main clothes load;

a removable basket removably mounted in a treating chamber at the front of the rotatable drum for accommodating one or more stationary laundry items;

a first sensor being located at the front of the rotatable drum and having a first sensing field; the first sensor being configured to emit a first data signal indicative of a presence or absence of the removable basket;

a space formed by the removable basket between a main portion of the rotatable drum and the first sensor and the sensing field extending into the space;

a second sensor with a second sensing field located at the rear of the laundry treating appliance and emitting a second data signal indicative of laundry within the second sensing field; and a controller receiving the first data signal and configured to execute a program to analyze the first data signal to determine the presence or absence of the removable basket and take an action in response to a determination that the removable basket is present.

2. The laundry treating appliance of claim 1 wherein the controller receives the second data signal and the execution of the program analyzes both the first and second data signals to determine a presence or absence of the removable basket.

3. The laundry treating appliance of claim 2 wherein the program compares the first and second signals as part of the analysis.

4. The laundry treating appliance of claim 1 wherein at least one of the first and second sensors are conductivity sensors.

5. The laundry treating appliance of claim 4 wherein the first sensor is a conductivity sensor located at a bottom portion of a front wall of the laundry treating appliance and the second sensor is a conductivity sensor located at a bottom portion of a rear wall of the laundry treating appliance.

6. The laundry treating appliance of claim 1 wherein at least one of the first or second sensors is a thermistor.

7. The laundry treating appliance of claim 6 further comprising an air inlet and an air outlet to the treating chamber and the thermistor is in fluid communication with one of the air inlet or air outlet.

8. The laundry treating appliance of claim 7 wherein each of the first and second sensors is a thermistor and the first sensor is located at the air inlet and the second sensor is located at the air outlet.

9. The laundry treating appliance of claim 1 wherein the removable basket comprises a portion that overlies the sensor.

10. The laundry treating appliance of claim 1 wherein the action comprises modifying a cycle selected for the main clothes load.

11. The laundry treating appliance of claim 10 wherein modifying the cycle comprises adding time to the cycle.

12. The laundry treating appliance of claim 1 wherein the action comprises indicating to a user, via a user interface, that a presence of the removable basket has been detected.

13. A method for operating a laundry treating appliance for drying laundry the method comprising:

receiving at a controller a first data signal associated with a first conductivity sensor indicative of a number of hits of laundry associated with the first conductivity sensor within a treating chamber;

comparing the first data signal to a reference value; and determining a presence or absence of a removable basket within the treating chamber based on the comparison of the number of hits of laundry associated with the first conductivity sensor compared to the reference value.

14. The method of claim 13 further comprising receiving at the controller a second data signal associated with a second conductivity sensor indicative of a presence of laundry at a different location in the treating chamber than the first data signal.

15. The method of claim 14 wherein comparing the first data signal to a reference value further includes comparing the first data signal to the second data signal.

16. The method of claim 15 further including detecting at least one of the first data or second data signal with at least one thermistor.

17. The method of claim 14 further comprising generating a ratio between the first data signal and a second data signal and comparing the ratio to the reference value.

18. The method of claim 14 further comprising comparing the second data signal to the first data signal to determine a difference value.

19. The method of claim 18 further comprising comparing the difference value to the reference value.

20. The method of claim 13 further comprising indicating the presence of the removable basket within the treating chamber when the first data signal is different than the reference value.

21. The method of claim 20 further comprising comparing the first data signal to a reference value for the first data signal.

22. The method of claim 13 further comprising setting a drying time to a predetermined amount of time.

23. The method of claim 22 wherein the setting a drying time further includes determining the predetermined amount of time based on a percentage of a cycle time already performed.

24. The method of claim 22 wherein the setting a drying time further includes extending the drying time by between 10 and 20 minutes.

25. The method of claim 13 wherein the receiving at a controller further includes receiving the reference value as a starting data signal at the start of a drying cycle.

26. The method of claim 13 further including comparing a second data signal to the starting data signal.

27. A laundry treating appliance for drying laundry comprising:

a rotatable drum having a front and a rear for tumble drying a main clothes load;

a removable basket removably mounted at the front of the rotatable drum for accommodating one or more stationary laundry items;

a first sensor configured to emit a first data signal indicative of the presence or absence of the removable basket; the removable basket comprising a portion that overlies the sensor; and a controller receiving the first data signal and configured to execute a program to analyze the first data signal to determine the presence or absence of the removable basket and take an action in response to a determination that the removable basket is present.

28. The laundry treating appliance of claim 27 wherein the removable basket forms a space between a main portion of the rotatable drum and the first sensor and wherein the first sensor is located at the front of the rotatable drum and has a first sensing field and the sensing field extends into the space.

29. The laundry treating appliance of claim 28 further comprising a second sensor with a second sensing field located at the rear of the laundry treating appliance and emitting a second data signal indicative of laundry within the sensing field.

* * * * *